US010006735B1

(12) United States Patent
Hagedorn et al.

(10) Patent No.: US 10,006,735 B1
(45) **Date of Patent: *Jun. 26, 2018**

(54) MOUNTING ASSEMBLY FOR A FIREARM

(71) Applicants: Mark Edward Hagedorn, Hendersonville, TN (US); Joe Bebee, Gallatin, TN (US)

(72) Inventors: Mark Edward Hagedorn, Hendersonville, TN (US); Joe Bebee, Gallatin, TN (US)

(73) Assignees: Mark E. Hagedorn, Hendersonville, TN (US); Connie L. Hagedorn, Hendersonville, TN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/612,508

(22) Filed: Jun. 2, 2017

Related U.S. Application Data

(63) Continuation of application No. 15/445,374, filed on Feb. 28, 2017, now Pat. No. 9,739,561.

(51) Int. Cl.
*F41A 27/18* (2006.01)
*F41H 5/20* (2006.01)
*F41A 25/00* (2006.01)

(52) U.S. Cl.
CPC ..... *F41A 27/18* (2013.01); *F41A 25/00* (2013.01); *F41H 5/20* (2013.01)

(58) Field of Classification Search
CPC ..... F41A 23/00; F41A 23/005; F41A 23/02; F41A 23/24; F41A 27/18
USPC ..... 89/37.03
See application file for complete search history.

(56) References Cited

U.S. PATENT DOCUMENTS

| | | | | |
|---|---|---|---|---|
| 381,475 | A | 4/1888 | Koerner | |
| 424,496 | A | 4/1890 | Nordenfelt | |
| 607,681 | A | 7/1898 | Cochrane | |
| 1,324,604 | A | 12/1919 | McKinney | |
| 1,335,403 | A | 3/1920 | Stanley | |
| 1,519,454 | A | 12/1924 | Inglis | |
| 1,547,295 | A | 7/1925 | Bull | |
| 1,608,595 | A * | 11/1926 | Green | F41A 23/005 89/40.06 |
| 1,625,124 | A * | 4/1927 | Jervey | F41A 23/12 89/40.06 |
| 1,701,153 | A | 2/1929 | Green | |
| 1,701,810 | A * | 2/1929 | Jervey | F41A 23/02 89/40.06 |
| 1,713,723 | A | 5/1929 | Studler | |

(Continued)

OTHER PUBLICATIONS

BMG Parts Co., "M240/M1919-Cradle-T," 2009, bmgparts.com/products/M2401919cradle.jpg.

(Continued)

*Primary Examiner* — Derrick R Morgan
(74) *Attorney, Agent, or Firm* — Eric B. Fugett; Mark A. Pitchford; Pitchford Fugett, PLLC

(57) ABSTRACT

The present disclosure provides a mounting assembly for a primary firearm, which may include a non-recoil reducing cradle pivotably coupled to a carriage configured to mount a selectively removable shield assembly. The mounting assembly includes a quick release pintle adaptor locking mechanism, which aids in the rapid mounting and dismounting of a secondary firearm to the mounting assembly.

20 Claims, 17 Drawing Sheets

(56) References Cited

U.S. PATENT DOCUMENTS

| | | | | | |
|---|---|---|---|---|---|
| 2,014,376 | A * | 9/1935 | Coupiand | F41A 27/06 | 89/37.14 |
| 2,039,198 | A | 4/1936 | Sutter | | |
| 2,210,538 | A * | 8/1940 | Ironside | F41A 9/34 | 89/40.06 |
| 2,343,863 | A * | 3/1944 | D Ardenne | F41A 17/38 | 89/1.1 |
| 2,356,751 | A * | 8/1944 | Colby | F41A 23/00 | 89/33.14 |
| 2,409,618 | A * | 10/1946 | Evans | F41A 27/16 | 188/42 |
| 2,415,340 | A * | 2/1947 | D Ardenne | F41A 23/00 | 89/36.13 |
| 2,441,874 | A | 5/1948 | Evans | | |
| 2,475,089 | A * | 7/1949 | Green | F41A 23/12 | 89/136 |
| 2,642,958 | A * | 6/1953 | Lennon | F41A 25/06 | 105/153 |
| 2,644,366 | A * | 7/1953 | Danielsen | F41A 19/10 | 267/135 |
| 6,250,197 | B1 | 6/2001 | Sanderson | | |
| 6,283,428 | B1 * | 9/2001 | Maples | F41A 23/34 | 248/282.1 |
| 6,371,424 | B1 * | 4/2002 | Shaw | F16M 11/041 | 248/187.1 |
| 7,415,790 | B1 | 8/2008 | Ruhland | | |
| 7,478,580 | B1 | 1/2009 | Parimi | | |
| 7,513,187 | B1 | 4/2009 | Lambermont | | |
| 7,543,524 | B1 | 6/2009 | Javorsky | | |
| D622,182 | S | 8/2010 | Parimi | | |
| 7,963,205 | B1 | 6/2011 | Brooks | | |
| 8,402,877 | B1 | 3/2013 | Petrosillo | | |
| 8,434,397 | B1 * | 5/2013 | Deckard | B64D 7/06 | 89/37.13 |
| 8,578,644 | B1 * | 11/2013 | Oquin | F41G 11/003 | 42/124 |
| 8,584,393 | B2 | 11/2013 | McCrimmon, Jr. | | |
| 8,590,441 | B1 * | 11/2013 | Good | F41G 11/001 | 42/146 |
| 9,086,255 | B1 | 7/2015 | Berman | | |
| 9,739,561 | B1 * | 8/2017 | Hagedorn | F41A 27/18 | |
| 2006/0048642 | A1 | 3/2006 | Beckmann | | |
| 2007/0131103 | A1 * | 6/2007 | McClellan | F41H 5/12 | 89/37.03 |
| 2010/0218668 | A1 | 9/2010 | McClellan | | |
| 2010/0294119 | A1 * | 11/2010 | Buechler | B64D 7/06 | 89/33.2 |
| 2012/0325077 | A1 * | 12/2012 | Davis | F41G 11/003 | 89/37.01 |
| 2013/0014419 | A1 * | 1/2013 | McCrimmon, Jr. | F41C 27/00 | 42/90 |
| 2014/0083284 | A1 | 3/2014 | Chu | | |
| 2014/0116238 | A1 * | 5/2014 | Hagedorn | F41A 27/30 | 89/37.03 |
| 2016/0216056 | A1 * | 7/2016 | Hagedorn | F41A 9/61 | |

OTHER PUBLICATIONS

BMG Parts Co., "M23 Cradle Assembly," 2013, bmgparts.com/products/M23.jpg.

BMG Parts Co., "Mk19," 2013, bmgparts.com/products/MK19MOD2.jpg.

Crane Technologies, Inc., "MK26 Softmount," 1999, cranetechnologiesinc.com/CompleteSoftMountMK26AndMK16SetUp.html.

U.S. Dept. of the Army, "Dual Mount Cradle Assembly Schematic," Dec. 1, 1987, Picatinny Arsenal, New Jersey, 07806.

U.S. Dept. of the Army, "Field Manual 3-22.27," Nov. 2003, 114 Army Pentagon, Washington, DC 20310.

* cited by examiner

MOUNTING ASSEMBLY FOR A FIREARM

CROSS-REFERENCES TO RELATED APPLICATIONS

This application is a continuation application of co-pending U.S. application Ser. No. 15/445,374, filed Feb. 28, 2017 and titled "MOUNTING ASSEMBLY FOR A FIREARM," the entire contents of which are hereby incorporated by reference.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

FIELD OF THE INVENTION

The present disclosure relates to the general field of firearms and, more particularly, to mounting systems for firearms.

BACKGROUND OF THE INVENTION

The use of weapon mounting systems to protect, support, and stabilize weapons and firearms is known. Weapon mounts are typically designed to mount a specific firearm to a vehicle or ground-based stabilizing support structure for a specific application. Among them are the group of heavy-duty armored recoil-reducing weapon mounts (known as "soft mounts" and "buffered mounts") with integral shock absorbing systems designed to reduce recoil and increase hit probability. However, such mounts are too large and heavy to be easily or quickly moved between support structures, particularly during fluid combat engagements, and can be rendered inoperable by the failure or destruction of various component mechanisms. By contrast, the group of non-recoil reducing gun mounts known as "hard mounts" and "bufferless mounts" are minimalist in design, relatively lightweight, and are less susceptible to failure. Though more compact and easier to quickly reposition between support structures than recoil reducing weapon mounts, non-recoil reducing weapon mounts must be deployed behind natural or artificial obstacles if the operator is to be protected from enemy fire because hard mounts are incapable of mounting and supporting a shield or other protective armor, which dramatically limits their operational capabilities.

Accordingly, what is needed are improvements in weapon mounts and mounting assemblies for firearms.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a mounting assembly for a firearm, comprising a carriage configured to mount a shield assembly; a pintle having a first end and a second end, the first end coupled to the carriage, the second end configured to be rotatably coupled to a support structure for a weapon mount; and a non-recoil reducing cradle configured to receive a firearm, the cradle having a forward end, an aft end, a cradle length extending from said forward end to said aft end, a left side, a right side, a cradle width extending from said left side to said right side, said cradle width being shorter than said cradle length; wherein said cradle is pivotably coupled to said carriage such that said cradle can pivot in a vertical plane relative to the carriage when said pintle is rotatably coupled to said support structure.

In another aspect, the disclosure provides a mounting assembly for a firearm, comprising a carriage for a weapon mount, said carriage including a substantially planar base plate having a left side, a right side, a plurality of mounting holes for attaching a shield assembly to the base plate, and two rearwardly swept struts extending generally upward from said left and right sides, said struts defining a space; a pintle having a first end and a second end, the first end coupled to said base plate, the second end configured to be rotatably coupled to a support structure for a weapon mount; and a bufferless cradle configured to receive a firearm, the cradle having a forward end, an aft end opposite the forward end, a cradle length extending from the forward end to the aft end, a left side, a right side opposite the left side, and a cradle width extending from the left side to the right side, the cradle width being less than the cradle length. The cradle can further include a substantially planar adaptor plate having a forward end, and aft end, and opposite left and right sides extending between the forward end and the aft end; a pair of upright side rails attached to opposite left and right sides of said adaptor plate, each side rail of said pair having a forward end, a rear end, and a first aperture defined through said rear end, said first aperture configured to receive a retaining pin; a gusset attached to the forward ends of said adaptor plate and said side rails; a canted cross member extending between the rear ends of said side rails; and a pair of opposing support bosses extending between forward ends of said side rails, said support bosses configured to receive a portion of said firearm therebetween; wherein said cradle is received in said space and said side rails are pivotably coupled to said struts such that said cradle can pivot in a vertical plane relative to said carriage when said pintle is rotatably coupled to said support structure.

In still another aspect, the disclosure provides a mounting assembly for a firearm, said mounting assembly consisting of a carriage including a substantially planar base plate having a forward end, a rear end, a left side, a right side, and two rearwardly swept struts extending generally upward from said left and right sides, said struts defining a space; a cradle configured to receive a firearm, the cradle received in said first space, the cradle having a forward end, an aft end, a cradle length extending from said forward end to said aft end, a left side, a right side, a cradle width extending from said left side to said right side, said cradle width being shorter than said cradle length, said cradle width being about 7.0 inches, said cradle including a substantially planar adaptor plate, the adaptor plate having a forward end, and aft end, and two opposite sides extending between said forward end and said aft end, a pair of upright side rails attached to said opposite sides of said adaptor plate, the side rails having a forward end, an aft end, a central region extending between said forward and aft ends, a pair of opposing support bosses configured to mount said firearm, said bosses extending a support boss distance from each of said forward ends of said side rails, a retaining pin extending through the aft end of said cradle, said retaining pin configured to retain said firearm against said bosses when said firearm is received in said cradle, a canted cross member extending between the aft ends of said side rails, a gusset attached to the forward ends of said adaptor plate and said side rails, a pair of spaced apart legs extending rearwardly from said cross member, each leg having an alignment hole extending through a distal end thereof at an angle transverse to a longitudinal axis of said cradle, a block secured to a bottom surface of said adaptor plate, a pintle socket extending through said adaptor plate and said block, a pintle bushing disposed in said pintle socket, a pin bore extending through said pintle block and said pintle bushing, said pin bore intersecting said pintle socket, and a quick release pin configured to retain an adaptor pintle in said pintle socket when said adaptor pintle is received in said pintle socket and said quick release pin is received in said pin bore; a pair of mounting bolts coupling said side rails to said struts such that said cradle is pivotable within said carriage about said mounting bolts; and a shield assembly attached to said carriage, the shield assembly including a mounting bracket and a shield having an aperture for a firearm, the mounting bracket having a first end and a second end, the first end attached to said carriage, the second end attached to said shield.

Numerous other objects, advantages and features of the present disclosure will be readily apparent to those of skill in the art upon a review of the following description, appended claims, and accompanying drawings.

DETAILED DESCRIPTION

Figure 1:
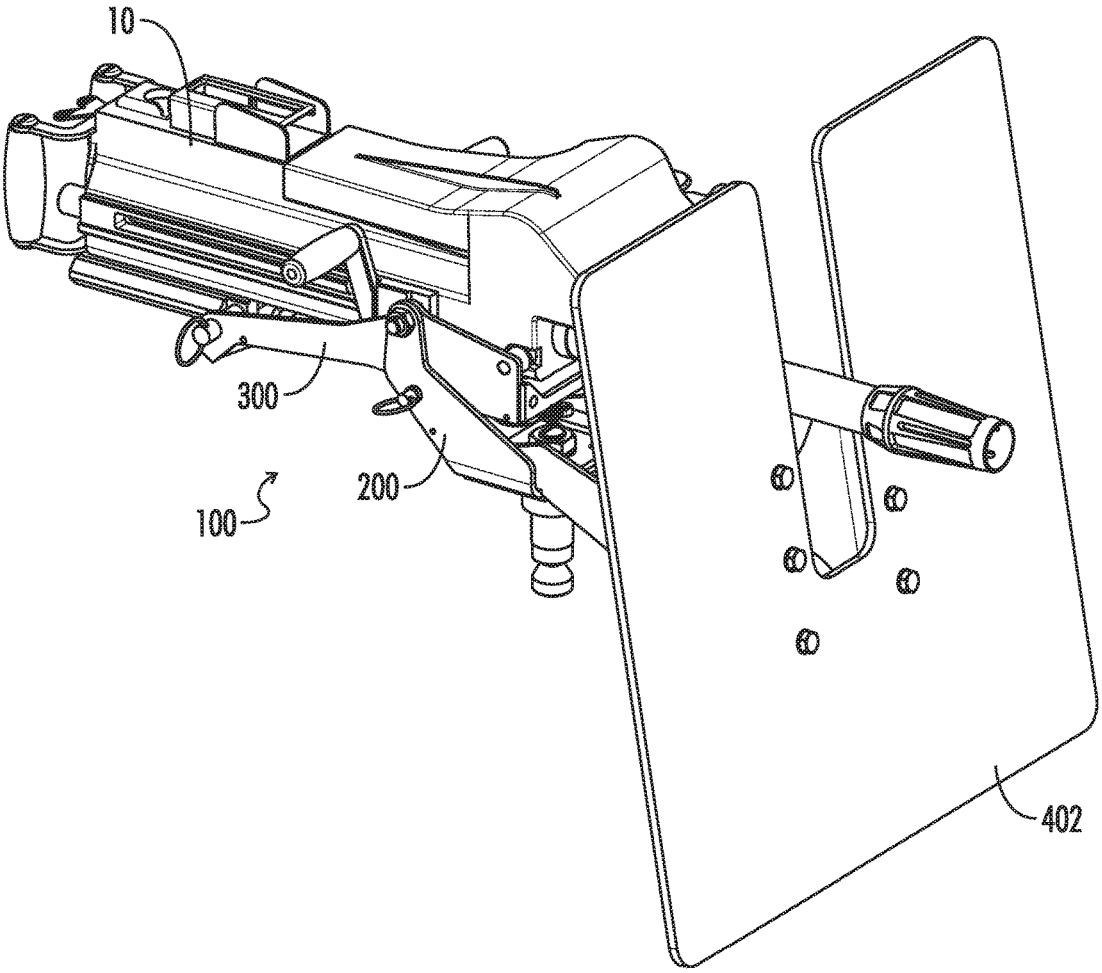
FIG. 1 is a perspective view an embodiment of a mounting assembly for a firearm showing a primary firearm received in the mounting assembly.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The term "when" is used to specify orientation for relative positions of components, not as a temporal limitation of the claims or apparatus described and claimed herein unless otherwise specified. The term "lateral" denotes a side to side direction when facing the "front" of an object.

In the drawings, not all reference numbers are included in each drawing, for the sake of clarity. In addition, positional terms such as "vertical," "horizontal," "upper," "lower," "side," "rear," "aft," "forward," "side," "top," "bottom," "above," "below," "upright," and other orientation terms refer to the apparatus when in the orientation shown in the drawing. A person of skill in the art will recognize that the apparatus can assume different orientations when in use.

The phrase "in one embodiment," as used herein, does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements, or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Turning now to FIGS. 1 through 15, wherein like reference numbers refer to like elements, there are provided multiple views of an embodiment of a mounting assembly 100 for a firearm 10. The mounting assembly 100 is a novel non-recoil reducing, armored "hard mount" which can mount a firearm 10 to a vehicular or ground-based support structure, such as a pedestal, tripod, or swing arm mount (not shown). The mounting assembly 100 disclosed herein is the first "bufferless" weapon mount designed to directly mount a removable shield assembly to protect an operator from frontal fire without the need for an external adaptor. As such, a mounting assembly 100 constructed in accordance with the present disclosure provides a more versatile, light-weight, and durable option for stably mounting a firearm to a support structure for use in a wider variety of tactical applications than currently available weapon mounts. For example, the ability to selectively affix a shield to the mounting assembly can help to minimize potential collateral damage by creating a non-lethal deterrent to potential combatants, as the odds of success in an attack decrease when a position is fortified. Unlike existing weapon mounts, the mounting assembly 100 is particularly advantageous for use in areas of operation where mobility, weight minimization and force protection are paramount, but suitably protective natural and artificial obstacles are unavailable.

Figure 2:
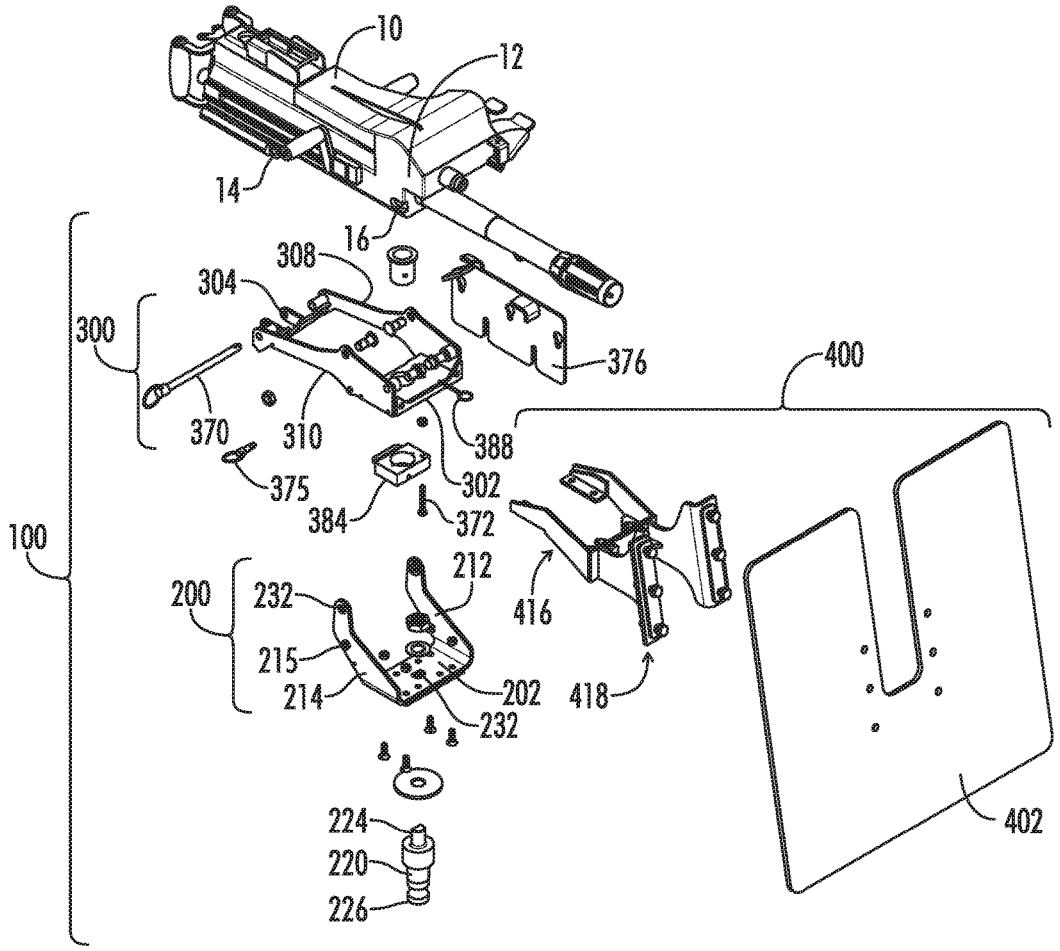
FIG. 2 is a partially exploded view of the mounting assembly of FIG. 1.

Referring now to FIGS. 1 and 2, a mounting assembly 100 generally comprises a carriage 200 for a recoil reducing weapon mount, a cradle 300 configured to receive a primary firearm 10, and a shield assembly 400 integrally mounted to the carriage 200. In use, the primary firearm 10 is received in the cradle 300, the cradle 300 is received in and pivotably coupled to the carriage 200, the carriage 200 is rotatably coupled to a support structure for a weapon mount (not shown), and the shield assembly 400 is rigidly secured to a portion of the carriage 200.

Figure 3:
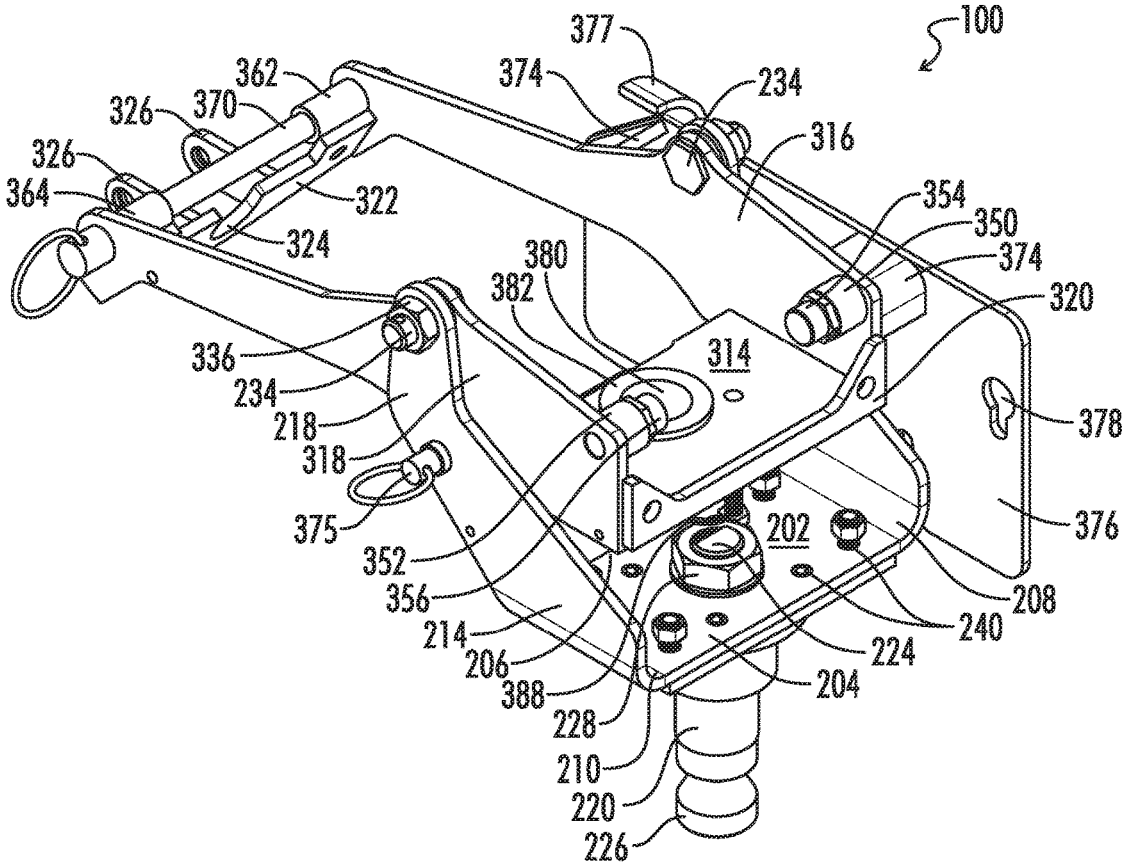
FIG. 3 is a perspective view of the mounting assembly of FIG. 1 with the primary firearm and the shield assembly removed.
Figure 4:
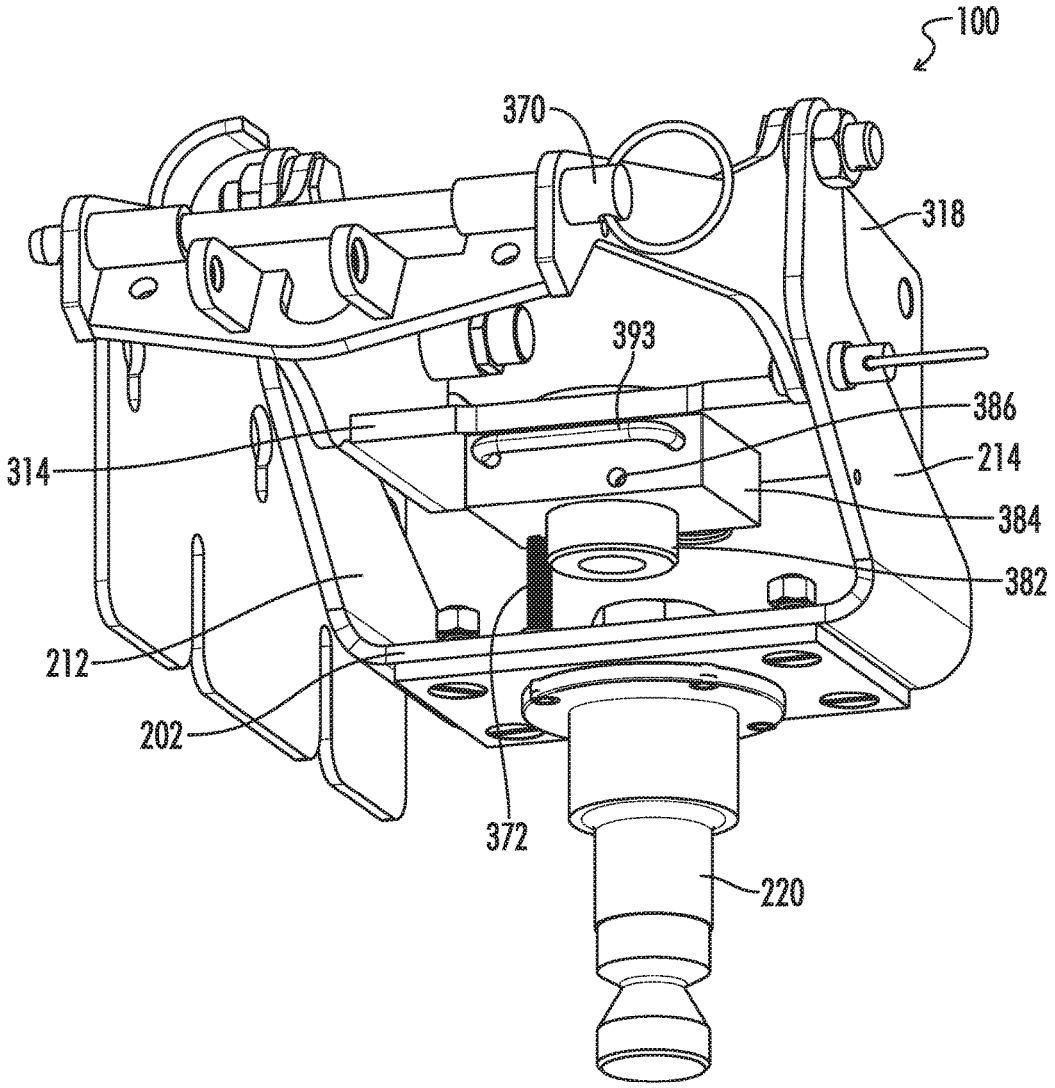
FIG. 4 is a rear perspective view of the mounting assembly of FIG. 3.
Figure 5:
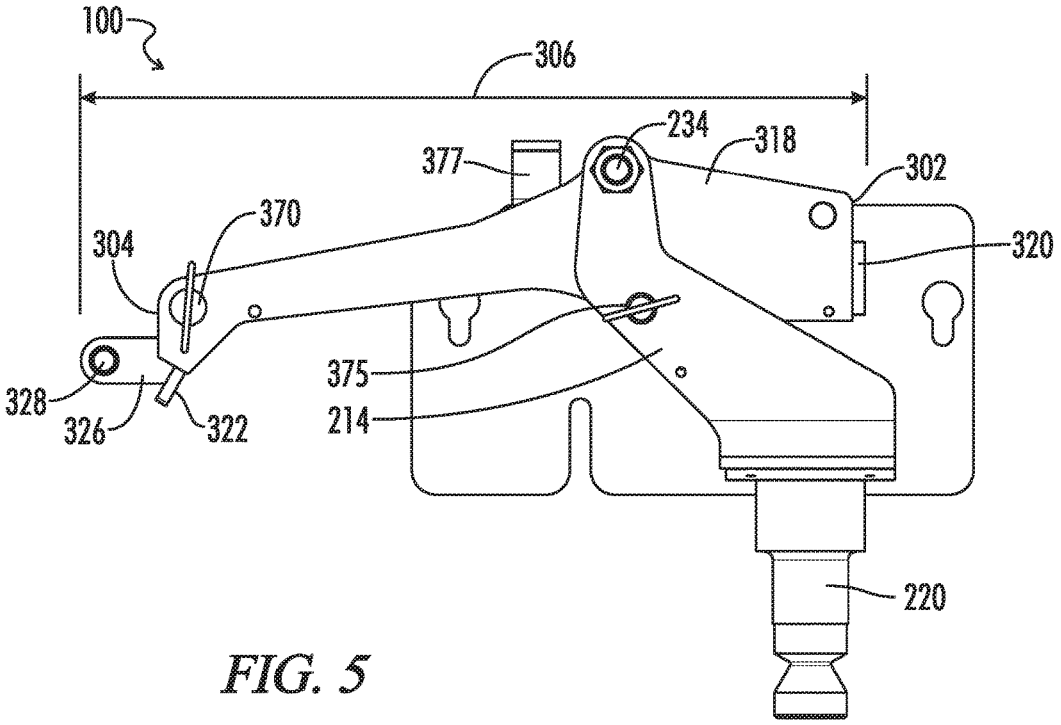
FIG. 5 is a right side elevational view of the mounting assembly of FIG. 3.
Figure 6:
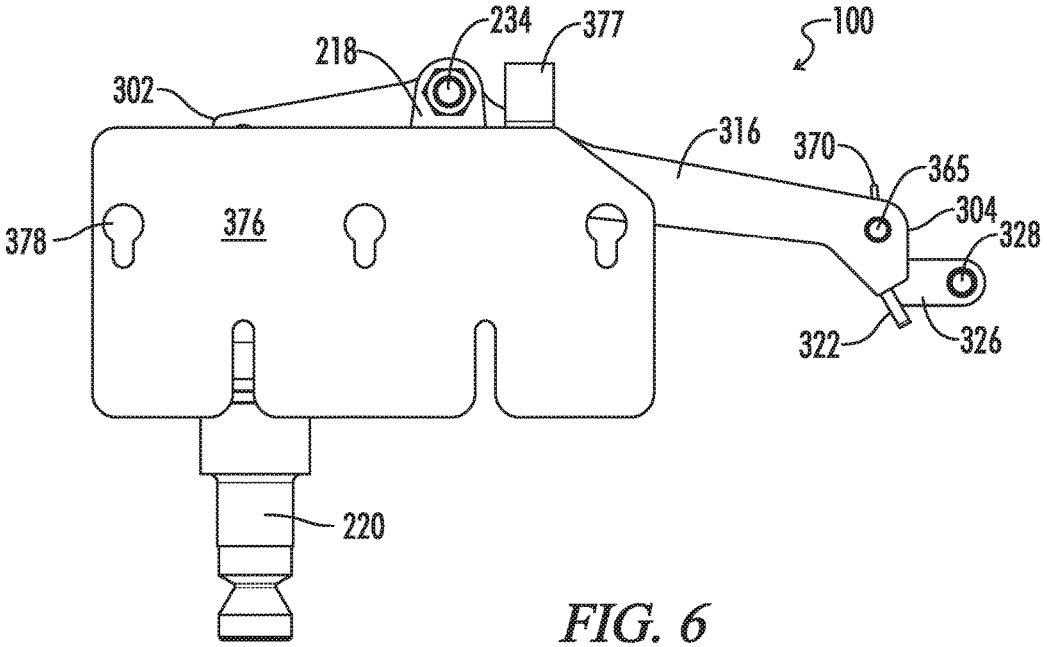
FIG. 6 is a left side elevational view of the mounting assembly of FIG. 3.
Figure 7:
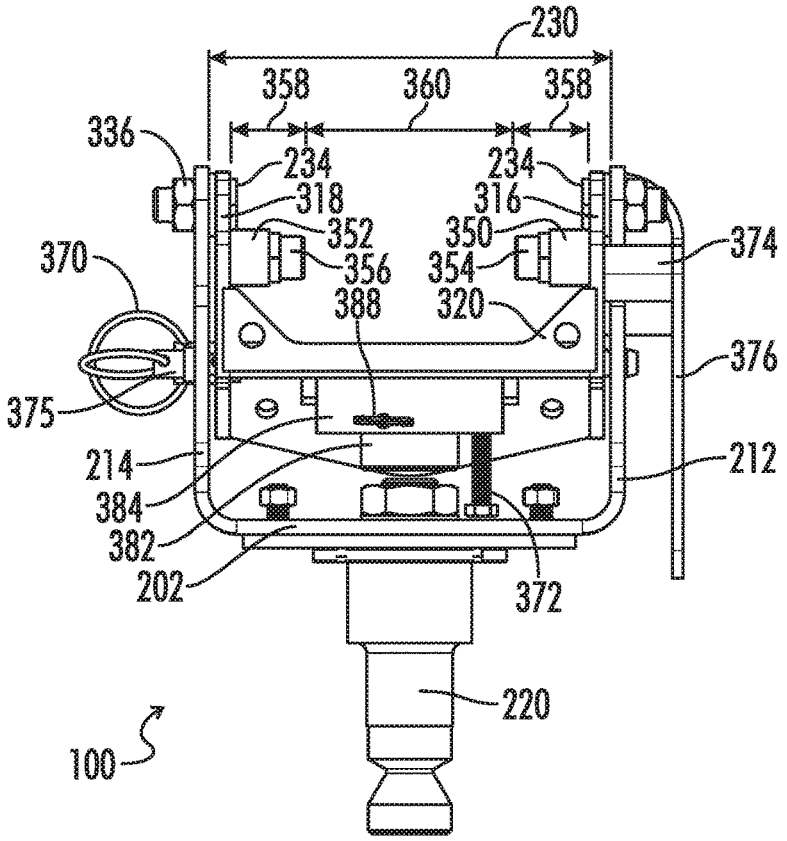
FIG. 7 is a front elevational view of the mounting assembly of FIG. 3.
Figure 8:
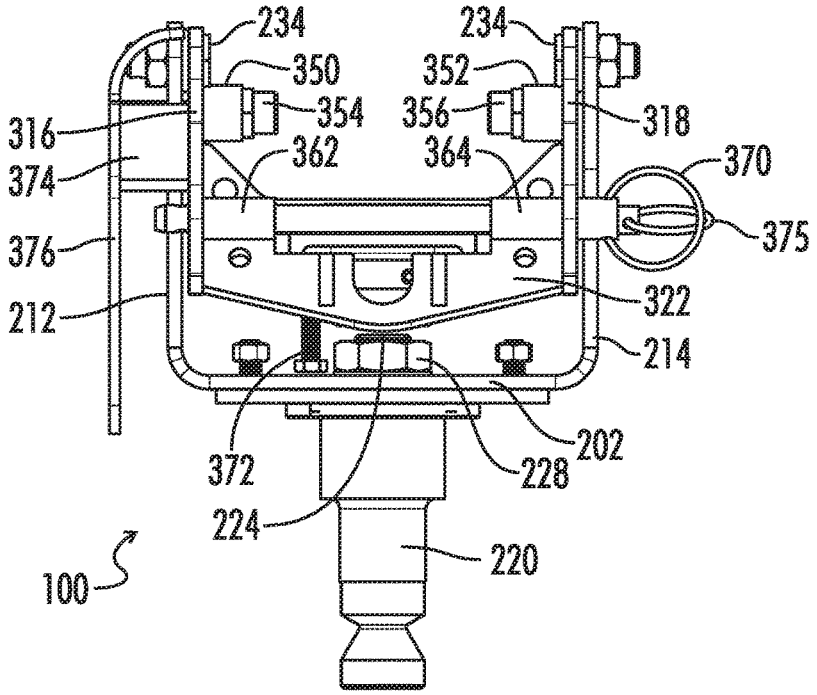
FIG. 8 is a rear elevational view of the mounting assembly of FIG. 3.
Figure 9:
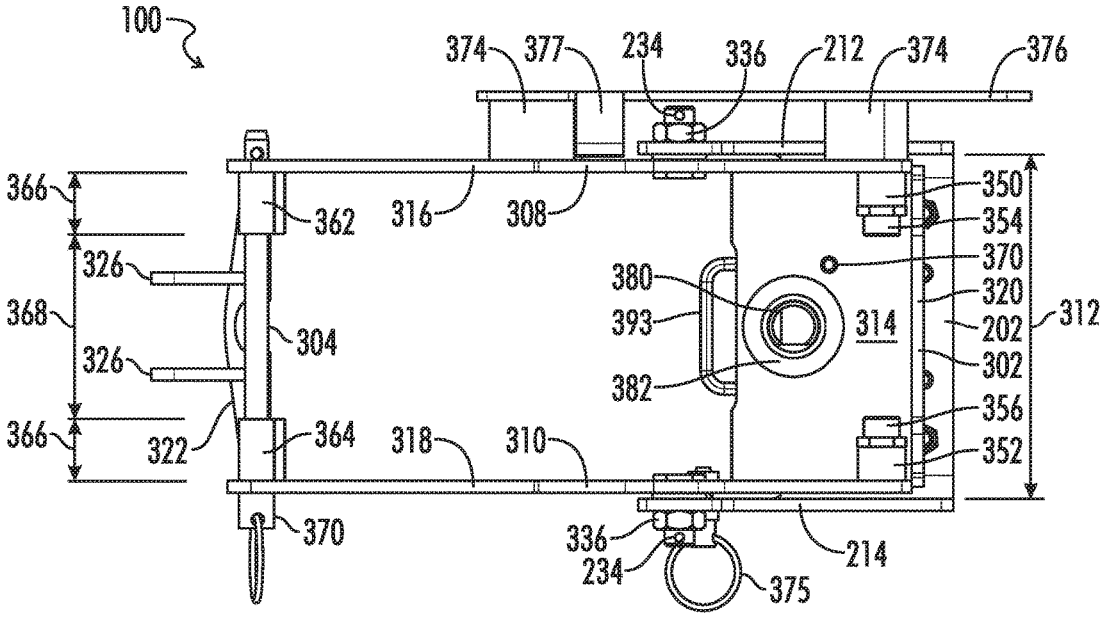
FIG. 9 is a top plan view of the mounting assembly of FIG. 3.
Figure 10:
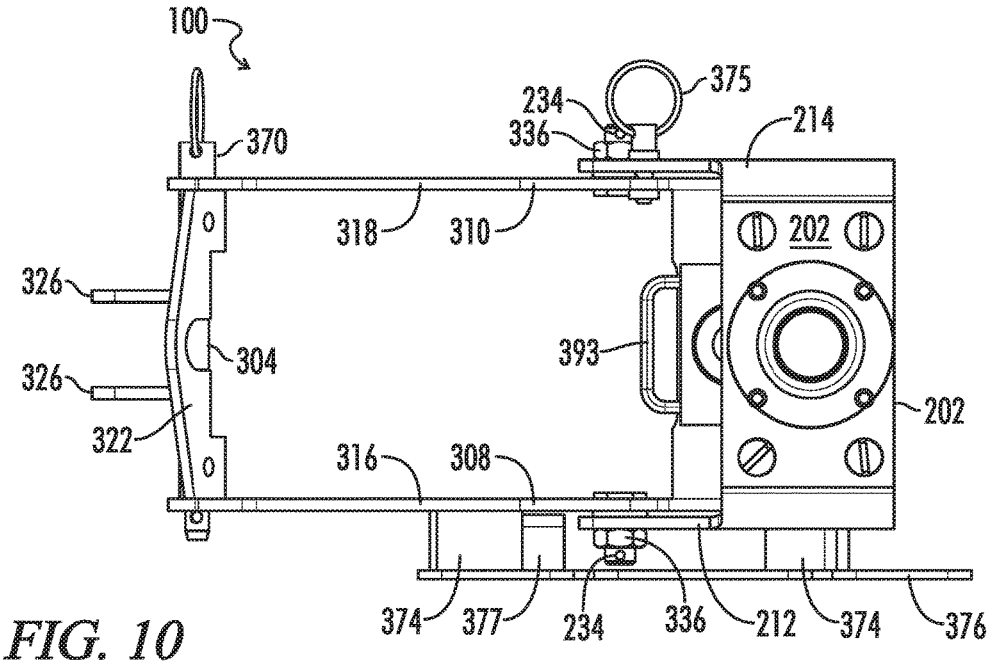
FIG. 10 is a bottom plan view of the mounting assembly of FIG. 3.

As best shown in FIGS. 2 through 4, the carriage 200 includes a substantially planar base plate 202 having a forward end 204, an aft end 206 opposite the forward, a left side 208, and a right side 210 opposite the left side; a pair of rearwardly swept left and right struts 212, 214 extending generally upward and aft from the left and right sides 208, 210 of the base plate 202 at a substantially right angle to the base plate planar surface, each strut having an exterior surface facing away from the opposite strut, and an interior surface facing toward the opposite strut; and a pintle 220 for mounting the mounting assembly 100 to a support structure for a weapon mount, the pintle 220 coupled to base plate 202.

Struts 212, 214 define a space 230 in which cradle 300 is received. In some embodiments, the space can have a width of about 7.25 inches. Each of the left and right struts 212, 214 includes a proximal end attached to the respective left or right side 208, 210 of the base plate 202 and a distal end 218 opposite the proximal end. The distal ends 218 of left and right struts 212, 214 include a mounting hole 232 through which a mounting bolt 234 engaging cradle 300 is inserted to pivotably couple the cradle assembly 300 to the carriage 200 when the cradle assembly 300 is received in carriage 200. In this way, cradle assembly 300 is made pivotable about the mounting bolts 234 in a vertical plane relative to the carriage 200 when the mounting assembly 100 is in an upright position.

Figure 12:
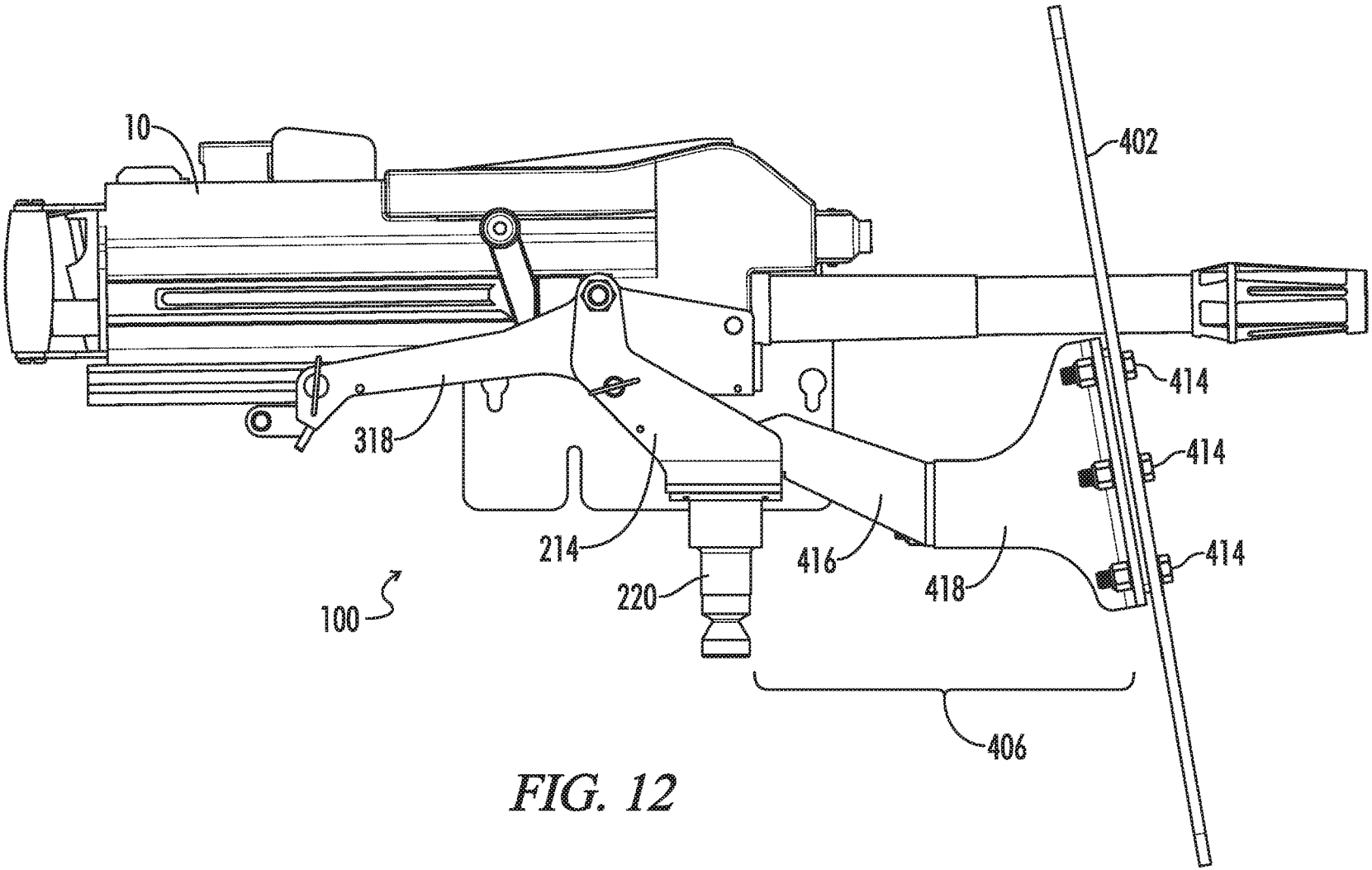
FIG. 12 is a right elevational view of the mounting assembly of FIG. 1.
Figure 13:
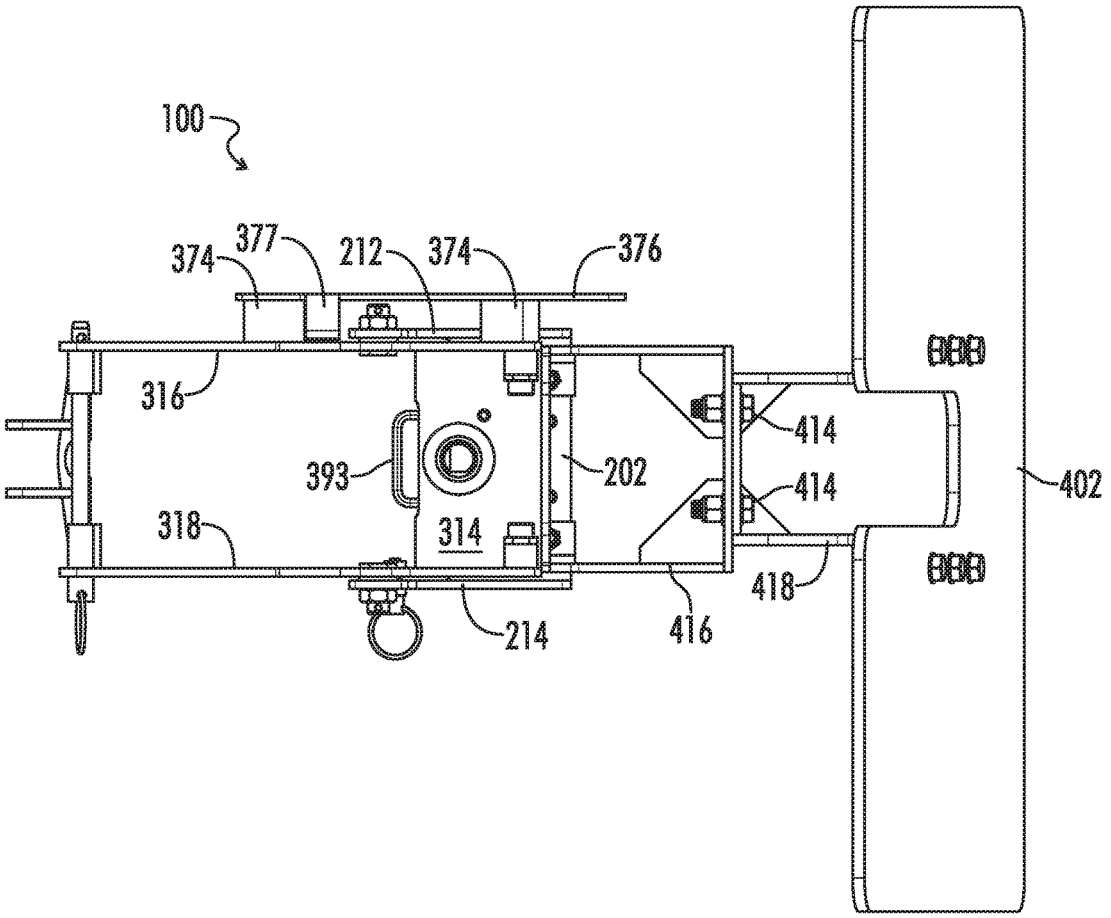
FIG. 13 is a top plan view of the mounting assembly of FIG. 1 with the primary firearm removed.
Figure 14:
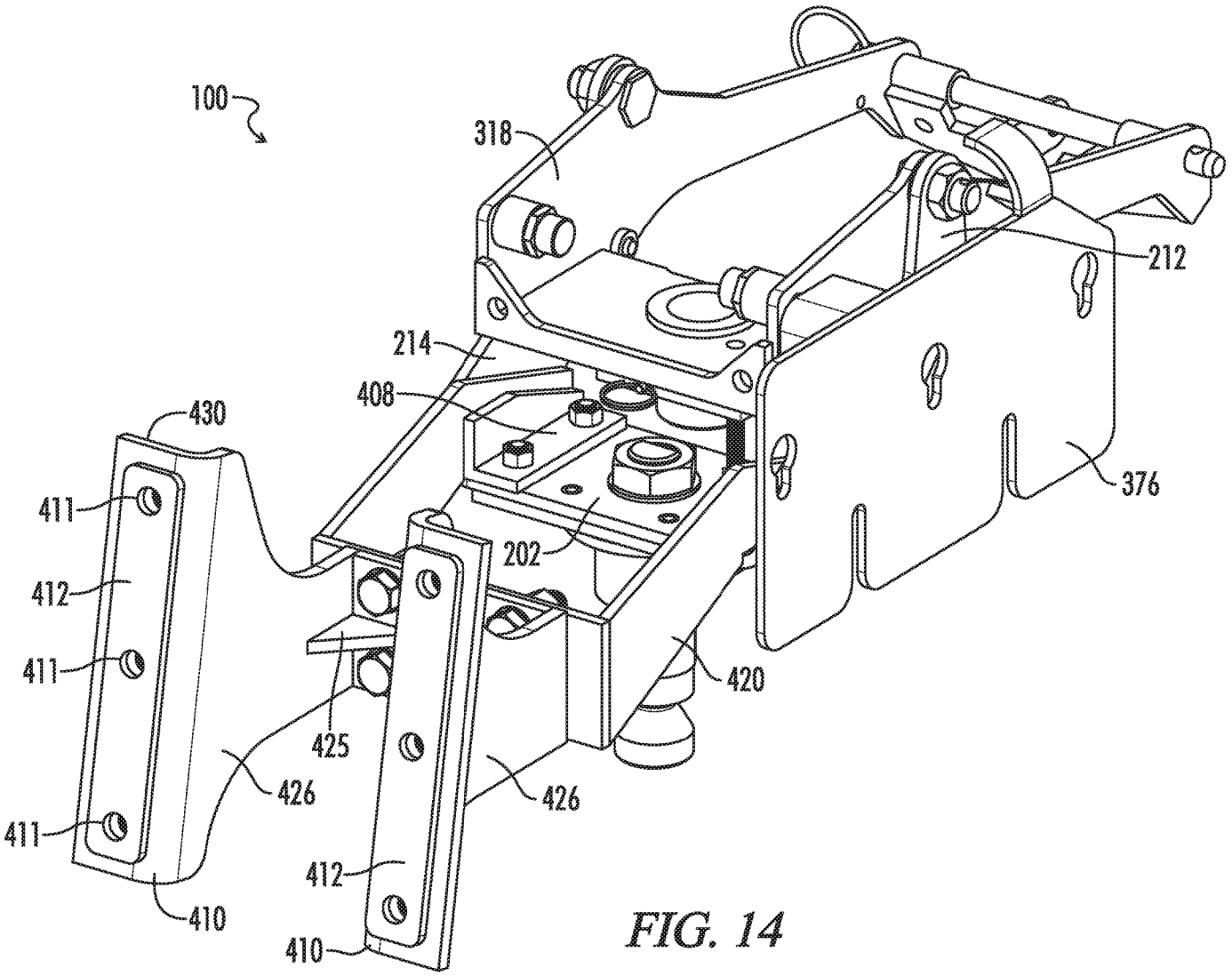
FIG. 14 is a left perspective view of the mounting assembly of FIG. 1 with the primary firearm and the shield removed.
Figure 15:
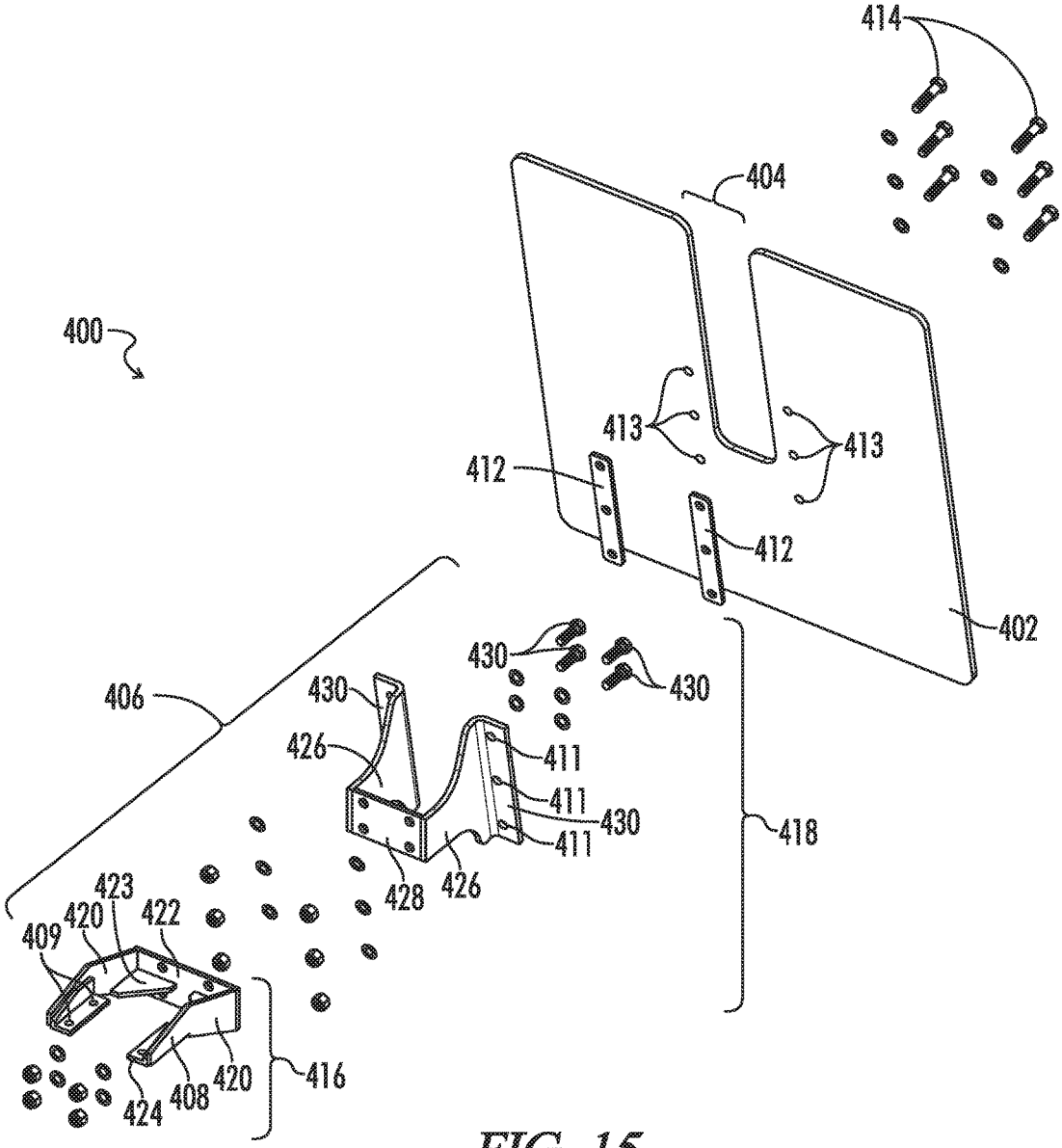
FIG. 15 is a rear exploded view of the shield assembly portion of the mounting assembly of FIG. 1.

Base plate 202 includes a central pintle hole 222 through which a portion of pintle 220 extends when the pintle is coupled to base plate 202. Pintle 220 includes a first end 224 and a second end 226 opposite the first end 224. First end 224 includes a threaded section which extends upward through pintle hole 222 from underneath base plate 202 and is engaged by a nut 228 to rigidly secure pintle 220 to base plate 202. Second end 226 includes an annular groove 229 designed to rotatably couple mounting assembly 100 to a support structure for a weapon mount when second end 226 is received in a support structure for a weapon mount having a socket for receiving pintle 220. Base plate 202 also includes a plurality of mounting holes 240 through which fasteners 414 engaging shield assembly 400 extend to rigidly secure shield assembly 400 to base plate 202 as shown in FIGS. 12 through 14. To accommodate the shield assembly 400 and permit an adequate range of motion of the cradle 300, carriage 200 includes no gussets or similar structure designed to reinforce struts 212, 214. As used herein, the term "fastener" can include any of the associated hardware used to fasten one component to another via mounting holes or apertures. Thus, fasteners can include bolts, washers, nuts, screws, pins and other similar devices suitable to achieve the connection or attachment described.

Turning now to FIGS. 3 through 11, the cradle 300 is a non-recoil reducing "bufferless" cradle designed without recoil reducing shock absorbers to be as light weight as possible while still providing adequate durability, reliability, and stabilizing support for a firearm 10 received therein. The cradle 300 has a forward end 302, an aft end 304 opposite the forward end, a cradle length 306 extending from the forward end to the aft end, a left side 308, a right side 310 opposite the left side, and a cradle width 312 extending from the left side to the right side. The cradle width 312 is shorter than the cradle length 306. In some embodiments, the cradle width 312 is about 7.0 inches.

The cradle 300 includes elongated left and right side rails 316, 318, each having a forward end, an aft end opposite the forward end, and a central region extending between the forward and aft ends, an exterior surface facing away from the opposite side rail, and an interior surface facing toward the opposite side rail; a substantially planar adaptor plate 314 having a forward end, a rear end, opposite left and right side edges, an upper surface, and a lower surface, the left and right side edges attached to the forward ends of the left and right side rails 316, 318; a gusset 320 attached to the forward ends of side rails 316, 318 and adaptor plate 314; and a canted cross member 322 extending between the aft ends of side rails 316, 318. The cross member 322 includes a notch 324 for receiving a portion of a traverse and elevating mechanism (not shown), and a pair of spaced apart legs 326 having a proximal end connected to the cross member, and a distal end opposite the proximal end, the distal ends of the legs extending rearwardly from the cross member 322 along a longitudinal axis of the cradle 300. Each leg 326 also includes an alignment hole 328 extending completely through the distal ends at an angle transverse to the length of the cradle 300.

The central regions of the side rails 316, 318 include mounting holes 340 which align with mounting holes 232 in struts 212, 214 when cradle 300 is received or seated in carriage 200. Cradle 300 is pivotably coupled to carriage 200 by mounting bolts 234, which extend through side rail mounting holes 340 and strut mounting holes 232 and are retained in place by nuts 236. In this way, cradle 300 is made pivotable about the mounting bolts 234 in a vertical plane relative to the carriage 200 when the mounting assembly 100 is in an upright position.

The forward end 302 of cradle 300 includes a pair of opposing forward support bosses 350, 352 for mounting a firearm 10. Bosses 350, 352 are attached to the forward ends of each side rail 316, 318 by pin mounts 354, 356, which together with bosses 350, 352, extend a first distance 358 toward each other from the interior surface of the forward end of each side rail 316, 318 to define a first space 360 in which a forward portion 12 of the firearm 10 can be received. In some embodiments, the first distance 358 can be about 1.33 inches, and the space 360 can have a width of about 3.82 inches.

The aft end 304 of cradle 300 includes a pair of hollow tubular guides 362, 364 extending a second distance 366 toward each other from the interior surface of the aft end of each side rail 316, 318 to define a second space 368 in which an aft portion 14 of the firearm 10 can be received. Guides 362, 364 include aft retaining pin apertures 365 which extend completely through guides 362, 364. The retaining pin apertures 365 are laterally aligned to receive retaining pin 370. In some embodiments, the second distance 366 can be 1.55 inches, and the second space 368 can have a width of 3.90 inches.

When the firearm 10 is mounted in cradle 300, the forward pin mounts 354, 356 are received in blind guide channels 16 formed in either side of the forward portion 12 of the firearm 10, while a rear portion of the firearm having a bore 14 defined therethrough is received between the aft guides 362, 364. The firearm 10 is locked in the cradle 300 by rear retaining pin 370, which extends through the laterally aligned retaining pin apertures 365 in guides 362, 364 and the bore 14 in the rear portion of the firearm to retain firearm 10 on forward pin mounts 354, 356. As such, the cradle 300 is designed to receive and mount a primary firearm 10 without the need for any kind of external adaptor. In a specific embodiment, the primary firearm 10 is a MK-19 40 mm automatic grenade launcher 10. However, to increase the operational capabilities of the mounting assembly 100, the cradle 300 is also designed to mount at least one secondary firearm 10*b* with the use of an external adaptor, such as a pintle adaptor 390. In some embodiments, the secondary firearm 10*b* is a crew served weapon. In a specific embodiment, the secondary firearm 10*b* is an M2 .50 caliber machine gun 10*b*.

Figure 11A:
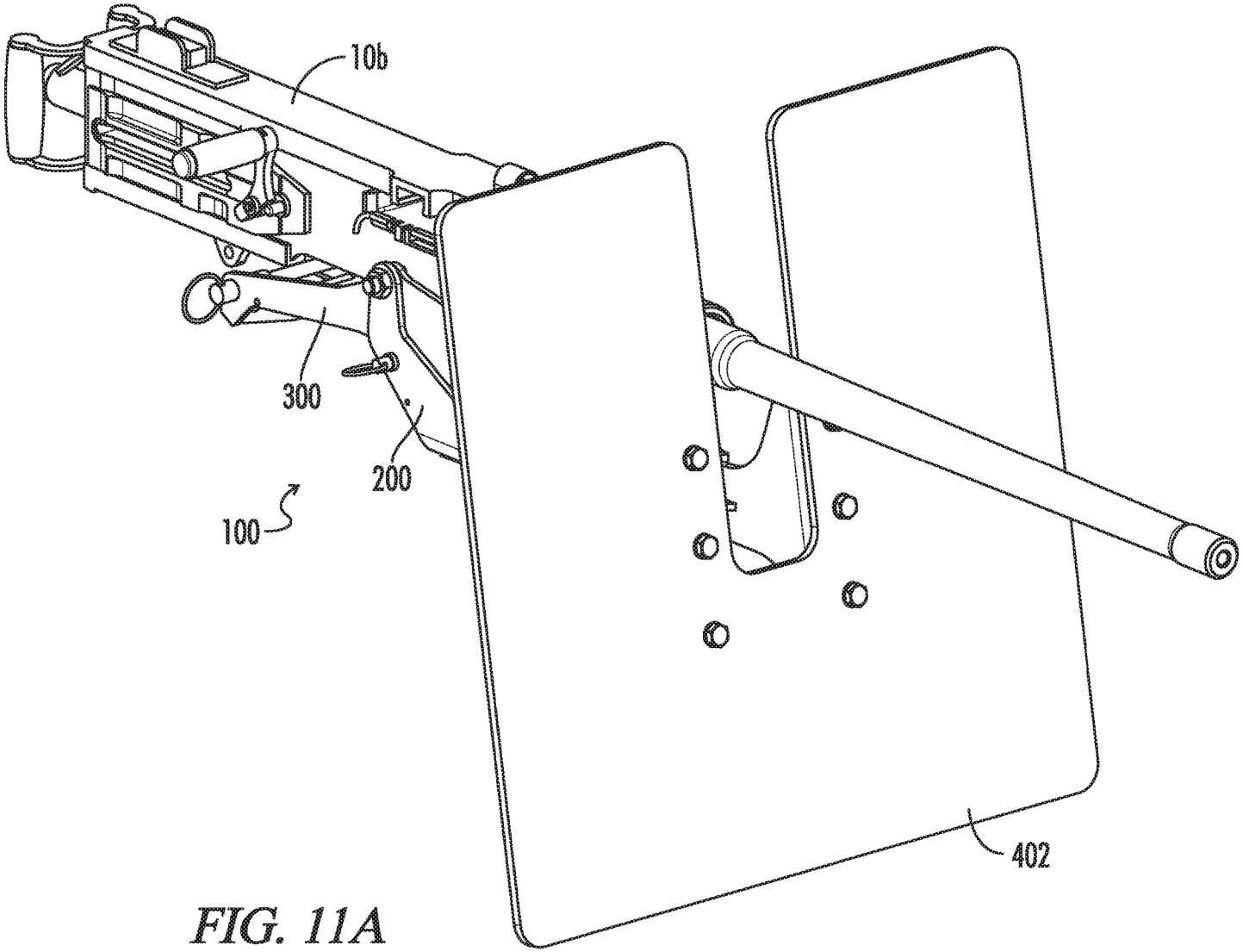
FIG. 11A is a perspective view of the mounting assembly of FIG. 1 with a secondary firearm received in the mounting assembly.
Figure 11B:
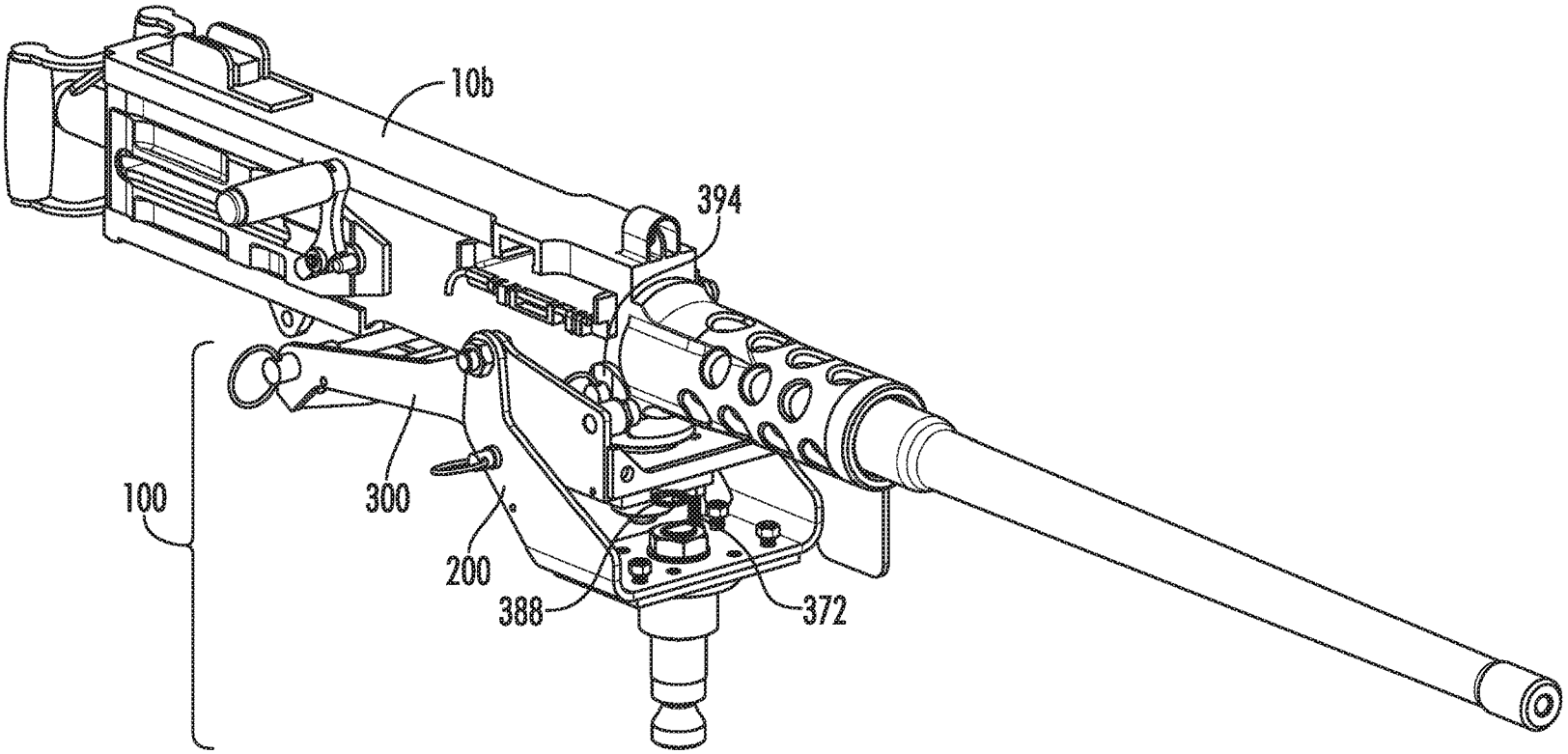
FIG. 11B is a perspective view of the mounting assembly of FIG. 11A with the shield assembly removed.
Figure 11C:
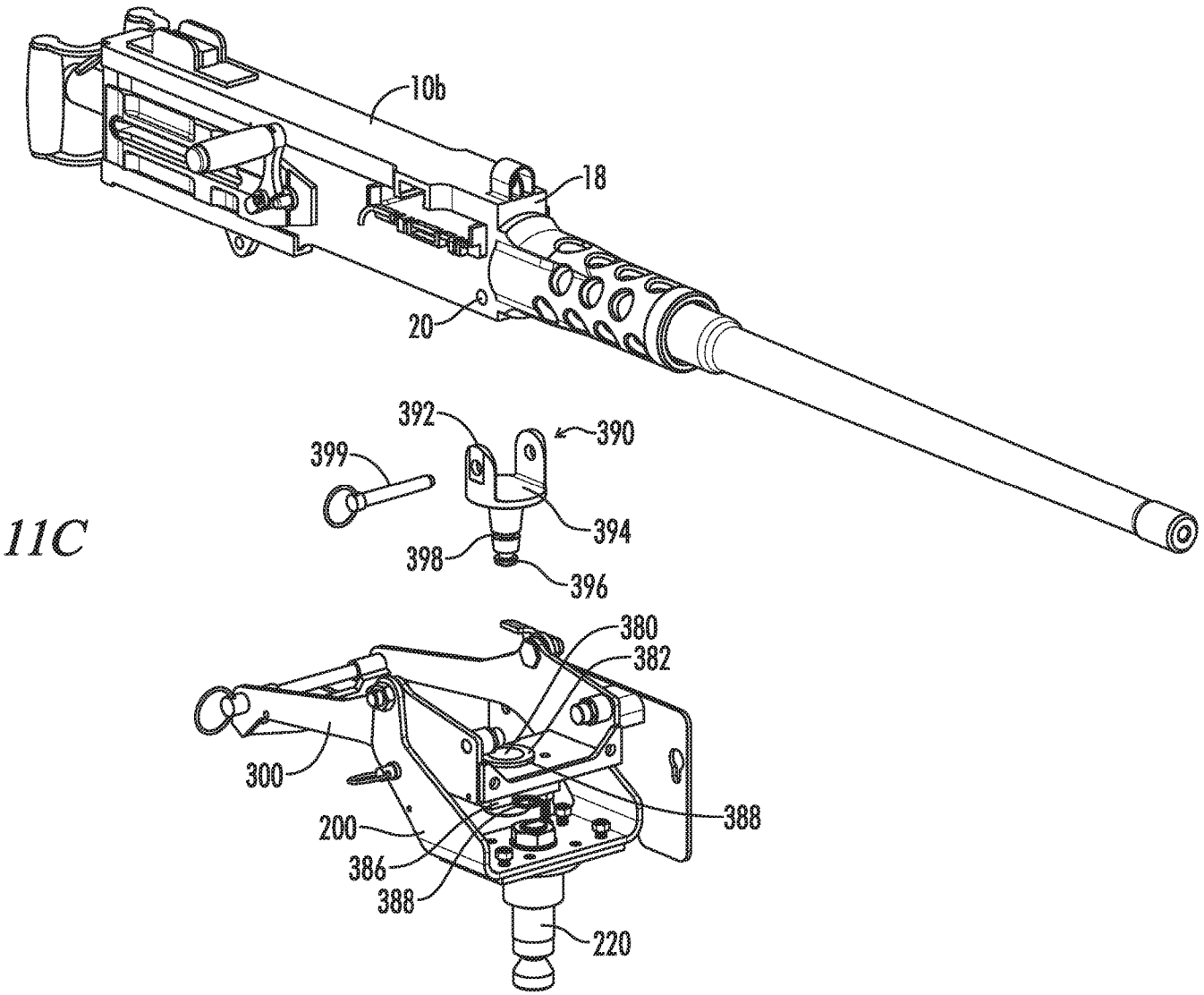
FIG. 11C is a partially exploded view of the mounting assembly of FIG. 11A.
Figure 11D:
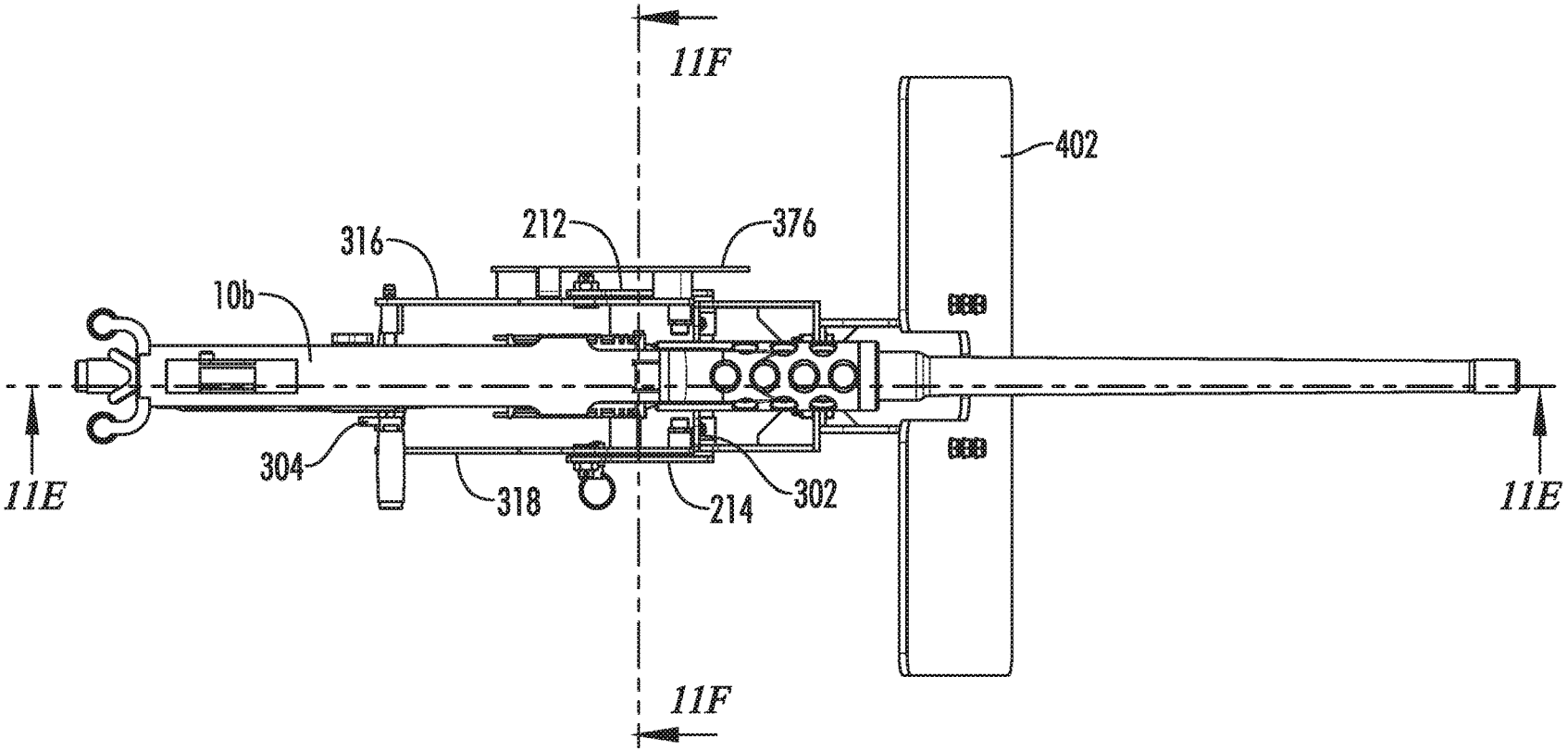
FIG. 11D is a top plan view of the mounting assembly of FIG. 11A.
Figure 11E:
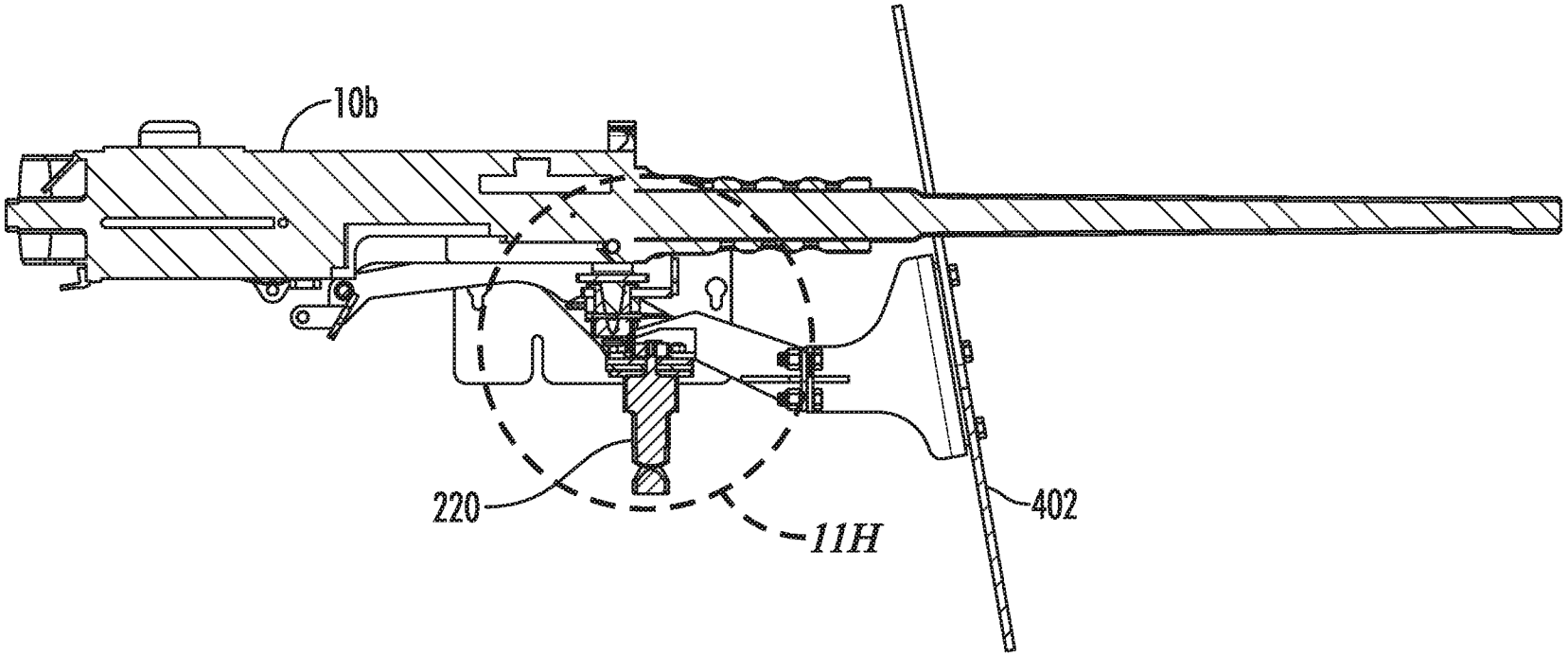
FIG. 11E is a cutaway side view of the mounting assembly of FIG. 11D.
Figure 11F:
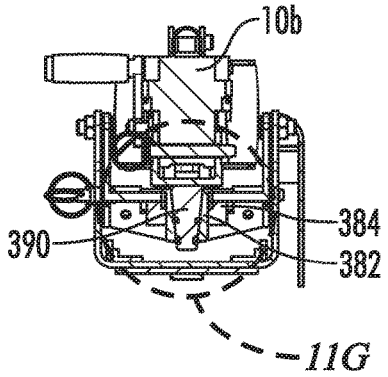
FIG. 11F is a cutaway front view of the mounting assembly of FIG. 11D.

Referring now to FIGS. 11A through 11H, the adaptor plate 314 includes a pintle socket 380 sized to receive a pintle adaptor 390 for mounting secondary firearm 10*b*. Pintle socket 380 extends completely through a central portion of the adaptor plate 314 located forward of mounting bolts 234. Pintle socket 380 can include a bushing 382 to permit pintle adaptor 390 to rotate within the pintle socket 380. Pintle adaptor 390 is smaller than pintle 220, and includes a first end 392 having a pintle yolk 394 and a second end 396 having an annular groove 398 extending around the circumference of the pintle at a uniform height. To mount the secondary firearm 10*b* to the mounting assembly 100, a forward portion 18 of the receiver of the secondary firearm 10*b* through which extends a passage 20 is placed in the yolk 394 as shown in FIGS. 11A and 11B, and a retaining pin 399 is inserted through the yolk 394 and the passage 20 to lock the secondary firearm 10*b* to the pintle adaptor 390. The second end 396 of the pintle adaptor 390 can then be inserted through the pintle socket 380 in adaptor plate 314 to mount the secondary firearm 10*b* to the mounting assembly 100.

Figure 11G:
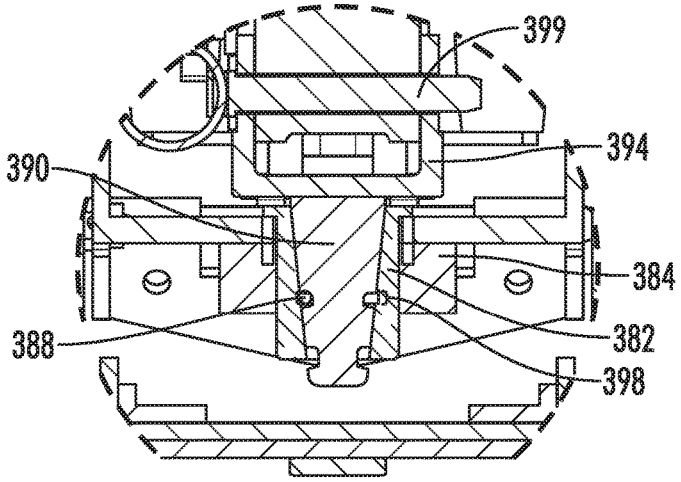
FIG. 11G is an enlarged view of the inset of FIG. 11F showing the quick release pin engaging the groove in pintle adaptor to lock pintle adaptor in the cradle.
Figure 11H:
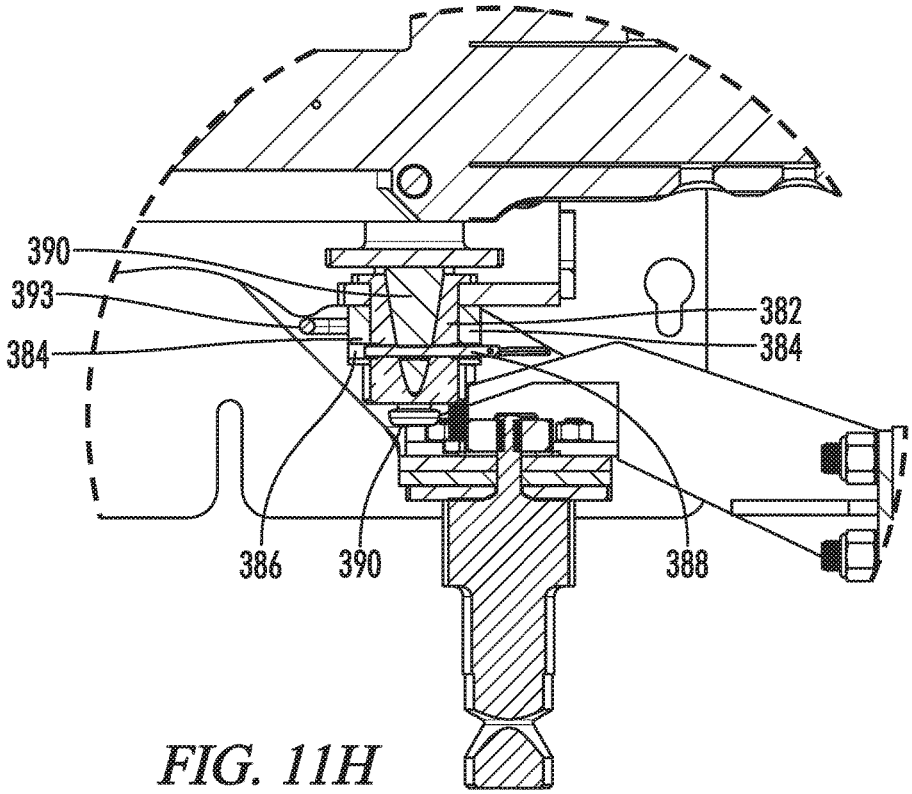
FIG. 11H is an enlarged view of the inset of FIG. 11E showing the quick release pin engaging the groove in pintle adaptor to lock pintle adaptor in the cradle.

To retain the pintle adaptor 390 in pintle socket 380, the mounting assembly advantageously includes a novel pintle retention system designed to facilitate rapid installation and removal of a secondary firearm 10*b* from the mounting assembly 100. The pintle retention system includes block 384, which is rigidly secured to a lower surface of the adaptor plate 314. Block 384 includes a forward end, a rear end opposite the rear end, opposite left and right sides extending between the forward and rear ends, and a thickness. Block can include a handle 393 extending from the rear end. The thickness of the block 384 is at least as great as the distance between the yolk 394 of pintle adaptor 390 and a lower edge of annular groove 398. Block is positioned directly below pintle socket 380 and pintle socket 380 extends completely through block 384, as does pintle bushing 382. A pin bore 386 extends through block 384 from the forward end to the rear end of the block 384. As best shown in FIGS. 11G and 11H, the pin bore 386 intersects pintle socket 380 and extends through pintle bushing 382 at a location corresponding to the annular groove 398 in the second end 396 of pintle adaptor 390. A selectably removable quick release pin 388 can be inserted through pin bore 386 to engage the annular groove 398 in pintle adaptor 390 and thus lock pintle adaptor 390 in the pintle socket 380 by preventing the pintle adaptor 390 from pulling out of the pintle socket 380. The quick release pin 388 can be pulled forward out of the pin bore 386 to unlock the pintle adaptor 390 from the pintle socket 380 so that the pintle adaptor 390 and the secondary firearm 10*b* can be quickly and easily removed from the pintle socket 380. This facilitates rapid installation and removal of the secondary firearm 10*b*, permitting a user to more quickly and easily exchange weapons mounted in the mounting assembly 100 than existing pintle retention mechanisms.

Referring again now to FIGS. 3 and 4, to prevent unintentional discharge of the firearm 10 below a pre-selected minimum plane of fire (e.g., a plane parallel to the ground), the adaptor plate 314 includes a threaded elevation control bore 370 and a hex head cap screw 372 threaded through a portion of the bore 370. The screw 372 limits the degree to which the cradle 300 can pivot forward in the carriage 200 by contacting the base plate 314 when the planar adaptor plate 314 reaches a pre-selected minimum plane of fire. A user may increase or decrease the minimum plane of fire by backing the screw 372 out of bore 370 or threading the screw 372 further into the bore 370, respectively. In this way, a user can configure the mounting assembly 100 to prevent the firearm 10 from pivoting below a pre-selected plane of fire, the discharge of the firearm below which could cause unintentional harm to friendly personnel or equipment, such as a vehicle to which the mounting assembly 100 is connected.

Similarly, to prevent the cradle 300 from pivoting within the carriage 200 during transportation, the mounting assembly 100 advantageously includes a stow pin and travel lock assembly. As such, the distal end of the right strut 214 includes a hole 215 extending from the exterior surface to the interior surface of the strut 214. The central region of the right side rail 318 also includes a similarly sized hole 315 extending from the exterior surface to the interior surface of the side rail 318. Holes 215 and 315 are oriented such that they align to form a stow pin bore for receiving a stow pin 375 when the cradle 300 is pivotably coupled to the carriage 200 and pivoted to a horizontal plane parallel to the carriage 200 as shown in FIG. 3. The stow pin 375 can be selectably inserted through the stow pin bore to lock the cradle 300 in a horizontal position parallel to the carriage 200 during transport. The stow pin 375 can be removed prior to use of the firearm 10 to permit the cradle 300 to pivot freely in the carriage 200.

The cradle can also include a mounting plate 376 provided with a plurality of mounting apertures 378 extending therethrough for selectively mounting an ammunition container to the mounting assembly 100. Mounting plate 376 includes a pair of spacers 374 to space mounting plate 376 away from the left side 308 of the cradle 300 so that the mounting plate 376 does not catch on carriage 200 and interfere with or inhibit pivoting of the cradle 300 within the carriage 200. An upwardly extending radial tab 377 connected to the mounting plate 376 can assist with feeding ammunition from an ammunition container into a firearm received in the cradle 300.

Referring now to FIGS. 12 through 15, the shield assembly 400 includes an armor shield 402 having an aperture 404 for a firearm; a mounting bracket 406 having a first end 408 provided with a plurality of mounting holes 409 arranged to align with mounting holes 240 in base plate 202 when bracket 406 is received in carriage 200, and a second end 410 provided with a plurality of mounting holes 411 arranged to align with mounting holes 413 in shield 402 when bracket 406 is placed against shield 402 for connection; and a plurality of fasteners 414 extending through aligned mounting holes 409, 240, and 411, 413 to attach the mounting bracket 406 to the base plate 202 and the shield 402, respectively. Mounting bracket 406 can be one segment or multiple segments coupled together by fasteners 414 or welds. In one embodiment, the bracket 406 comprises a first segment 416 and a second segment 418 coupled to the first segment by a plurality of fasteners 414.

The first segment 416 includes a pair of horizontal shafts 420 having a forward end and an aft end. The forward end of each shaft 420 is connected by a first bracket plate 422, which may be reinforced by one or more gussets 423, while the aft end of each shaft 420 includes a planar tab 424 through which extend mounting holes 409 that align with mounting holes 240 in base plate 202 when the aft end of shafts 420 are received against base plate 202 of carriage 200. A plurality of fasteners 414 extending through mounting holes 409 in tab 424 and mounting holes 240 in base plate 202 connect the first bracket segment 416 to the carriage 200.

The second segment 418 of the mounting bracket 406 includes a pair of vertical shafts 426 having a forward end and an aft end. The aft end of each vertical shaft 426 is connected by a second bracket plate 428, which may be reinforced by one or more gussets 425, while the forward end of each shaft 426 includes a planar tab 430 through which extend mounting holes 411 that align with mounting holes 413 in shield 402 when the forward end of shafts 426 are received against shield 402. A plurality of fasteners 414 extending through mounting holes 411 in tab 430 and mounting holes 413 in shield 402 connect the second bracket segment 418 to the shield 402. A pair of elongated shield cushions 412 can be disposed between the tab 430 at the second end 410 of the mounting bracket 406 and the shield 402 to dampen shock transmitted through the shield 402 to the bracket 406 when the shield 402 receives an impact during use.

A variety of different materials may be utilized in forming the various components of the mounting assembly 100 disclosed herein. Mounting assembly 100 may be formed, forged, cast or machined from conventional steels as well as alloy steels or heat-treatable stainless steels, among others. In optional embodiments, shield assembly bracket 406 may be formed as a weldment or alternatively forged or machined from a solid piece of material. Carriage 200 and cradle 300 may also be formed of various materials.

Thus, although there have been described particular embodiments of the present invention of a new and useful MOUNTING ASSEMBLY FOR A FIREARM, it is not intended that such references be construed as limitations upon the scope of this invention.

What is claimed is:

1. A mounting assembly for a firearm, comprising:

a carriage configured to mount a shield assembly;

a pintle having a first end and a second end, the first end coupled to the carriage, the second end configured to be rotatably coupled to a support structure for a weapon mount; and a non-recoil reducing cradle configured to receive a firearm, the cradle having a forward end, an aft end, a cradle length extending from said forward end to said aft end, a left side, a right side, a cradle width extending from said left side to said right side, said cradle width being shorter than said cradle length;

wherein said cradle is pivotably coupled to said carriage such that said cradle can pivot in a vertical plane relative to the carriage when said pintle is rotatably coupled to said support structure;

wherein the cradle includes:

a pair of opposing support bosses configured to mount a firearm at the forward end;

a substantially planar adaptor plate;

a pintle block secured to a bottom surface of said adaptor plate, a pintle socket extending through said adaptor plate and said pintle block, the pintle socket configured to receive an adaptor pintle therein.

2. The mounting assembly of claim 1, wherein the pair of opposing support bosses are configured to mount a firearm, and said aft end includes a retaining pin configured to retain a firearm received against said bosses in said cradle.

3. The mounting assembly of claim 1, wherein said carriage includes a substantially planar base plate having a left side and a right side, and two rearwardly swept struts extending generally upward from said left and right sides, said struts defining a space in which said cradle is received when said cradle is pivotably coupled to said carriage.

4. The mounting assembly of claim 1, further comprising a stow pin and a passage configured to receive said stow pin extending through the right side of said cradle and the right strut of said carriage when said cradle is in a horizontal position parallel to said base plate, the stow pin configured to be removably receivable in said passage to selectively lock said cradle in said position.

5. The mounting assembly of claim 1, further comprising:

at least one spacer member attached to the left side of said cradle, and a mounting plate configured to mount an ammunition container, said mounting plate attached to a side of said at least one spacer member opposite said cradle.

6. The mounting assembly of claim 1, further comprising a selectively removable shield assembly attached to said carriage, said shield assembly including a mounting bracket and a shield having an aperture for a firearm, the mounting bracket having a first end and a second end, the first end attached to said carriage, the second end attached to said shield.

7. The mounting assembly of claim 1, wherein said cradle includes:

the substantially planar adaptor plate having a forward end, and aft end, and two opposite sides extending between said forward end and said aft ends;

a pair of side rails attached to opposite sides of said adaptor plate, each side rail of said pair having a forward end and an aft end; and a cross member extending between the rear end of said side rails.

8. The mounting assembly of claim 6, further comprising:

the pintle block having a forward end, a rear end opposite the forward end, and two opposite sides extending between said forward end and said rear end;

a pintle socket extending through said adaptor plate and said block; a pin bore extending through said pintle block, said pin bore intersecting said pintle socket;

a quick release pin configured to selectively retain the adaptor pintle in said socket when said adaptor pintle is received in said socket and said quick release pin is received in said pin bore.

9. The mounting assembly of claim 8, wherein said adaptor pintle includes a first end configured to receive a second firearm and a second end opposite the first end, the second end having an annular groove extending around a circumference of said adaptor pintle; and wherein said quick release in engages said annular groove to prevent withdrawal of said pintle adaptor from said socket when said adaptor pintle is received in said socket and said pin is received in said pin bore.

10. The mounting assembly of claim 8, further comprising a pair of spaced apart legs extending rearwardly from said cross member, each leg having an alignment hole extending therethrough at an angle transverse to said cradle length.

11. The mounting assembly of claim 1, wherein said cradle width is about 7.0 inches.

12. The mounting assembly of claim 1, wherein the firearm is a MK-19 automatic grenade launcher.

13. A mounting assembly for a firearm, comprising:

a carriage for a weapon mount, said carriage including a substantially planar base plate having a left side, a right side, a plurality of mounting holes for attaching a shield assembly to the base plate, and two rearwardly swept struts extending generally upward from said left and right sides, said struts defining a space;

a pintle having a first end and a second end, the first end coupled to said base plate, the second end configured to be rotatably coupled to a support structure for a weapon mount; and a bufferless cradle configured to receive a firearm, the cradle having a forward end, an aft end opposite the forward end, a cradle length extending from the forward end to the aft end, a left side, a right side opposite the left side, and a cradle width extending from the left side to the right side, the cradle width being less than the cradle length, the cradle including:

a substantially planar adaptor plate having a forward end, and aft end, and opposite left and right sides extending between the forward end and the aft end, a pair of upright side rails attached to opposite left and right sides of said adaptor plate, each side rail of said pair having a forward end, a rear end, and a first aperture defined through said rear end, said first aperture configured to receive a retaining pin, a cross member extending between the rear ends of said side rails, and a pair of opposing support bosses extending between forward ends of said side rails, said support bosses configured to receive a portion of said firearm therebetween;

wherein said cradle is received in said space and said side rails are pivotably coupled to said struts such that said cradle can pivot in a vertical plane relative to said carriage when said pintle is rotatably coupled to said support structure;

wherein the cradle includes:

a substantially planar adaptor plate;

a pintle block secured to a bottom surface of said adaptor plate, a pintle socket extending through said adaptor plate and said pintle block, the pintle socket configured to receive an adaptor pintle therein.

14. The mounting assembly of claim 13, further comprising:

a pin bore extending through said pintle block, said pin bore intersecting said pintle socket;

a quick release pin configured to selectively retain an adaptor pintle in said socket when said adaptor pintle is received in said socket and said quick release pin is received in said pin bore.

15. The mounting assembly of claim 13, further comprising:

a mounting hole defined though an end of each of said struts distal to said base plate;

a second aperture defined through a central region of each side rail located aft of said base plate, wherein each second aperture aligns with each mounting hole to form a pair of opposing mounting fastener passages when said cradle is received in said space between said struts; and a pair of mounting fasteners extending through said opposing mounting passages to pivotably couple said side rails to said struts.

16. The mounting assembly of claim 13, further comprising a pair of spaced apart legs extending rearwardly from said cross member, each leg having an alignment hole extending therethrough at an angle transverse to said cradle length.

17. The mounting assembly of claim 13, wherein the width of the space is about 7.25 inches.

18. A mounting assembly for a firearm, said mounting assembly consisting of:

a carriage including a substantially planar base plate having a forward end, a rear end, a left side, a right side, and two rearwardly swept struts extending generally upward from said left and right sides, said struts defining a space;

a cradle configured to receive a firearm, the cradle received in said space, the cradle having a forward end, an aft end, a cradle length extending from said forward end to said aft end, a left side, a right side, a cradle width extending from said left side to said right side, said cradle width being shorter than said cradle length, said cradle including:

a substantially planar adaptor plate, the adaptor plate having a forward end, and aft end, and two opposite sides extending between said forward end and said aft end, a pair of upright side rails attached to said opposite sides of said adaptor plate, the side rails having a forward end, an aft end, a central region extending between said forward and aft ends, a pair of opposing support bosses configured to mount said firearm, said bosses extending a support boss distance from each of said forward ends of said side rails, a retaining pin extending through the aft end of said cradle, said retaining pin configured to retain said firearm against said bosses when said firearm is received in said cradle, a cross member extending between the aft ends of said side rails, a pair of spaced apart legs extending rearwardly from said cross member, each leg having an alignment hole extending through a distal end thereof at an angle transverse to said cradle length, a block secured to a bottom surface of said adaptor plate, a pintle socket extending through said adaptor plate and said block, a pin bore extending through said pintle block, said pin bore intersecting said pintle socket, and a quick release pin configured to retain an adaptor pintle in said pintle socket when said adaptor pintle is received in said pintle socket and said quick release pin is received in said pin bore;

a pair of mounting bolts coupling said side rails to said struts such that said cradle is pivotable within said carriage about said mounting bolts; and a shield assembly attached to said carriage, the shield assembly including a mounting bracket and a shield having an aperture for a firearm, the mounting bracket having a first end and a second end, the first end attached to said carriage, the second end attached to said shield.

19. The mounting assembly of claim 18, wherein said mounting bracket includes a first segment and a second segment attached to the first segment;

the first segment including a pair of horizontal shafts having a forward end and an aft end, the forward end of each horizontal shaft connected by a first bracket plate, the aft end of each horizontal shaft including a first planar tab, said first planar tabs coupled to said base plate;

the second segment including a pair of vertical shafts having a forward end and an aft end, the aft end of each vertical shaft connected by a second bracket plate, the forward end of each vertical shaft includes a second planar tab, said second planar tabs coupled to said shield.

20. The mounting assembly of claim 18, wherein said boss distance is about 1.33 inches, and said cradle width is about 7.0 inches.

* * * * *